US007712229B2

(12) United States Patent
Yang

(10) Patent No.: US 7,712,229 B2
(45) Date of Patent: May 11, 2010

(54) AIR-CIRCULATING SHOCK ABSORBING SHOES

(76) Inventor: Hee Woon Yang, 99 Yangpyoung-Dong, Youngdeungpo-Gu, 102 Dong 301 Ho Hansol Apt., Seoul (KR)

( * ) Notice: Subject to any disclaimer, the term of this patent is extended or adjusted under 35 U.S.C. 154(b) by 580 days.

(21) Appl. No.: 11/744,184

(22) Filed: May 3, 2007

(65) Prior Publication Data

US 2008/0184600 A1 Aug. 7, 2008

(30) Foreign Application Priority Data

Feb. 7, 2007 (KR) ..... 10-2007-0012456

(51) Int. Cl.
*A43B 13/18* (2006.01)
*A43B 13/20* (2006.01)

(52) U.S. Cl. ..... 36/3 B; 36/29

(58) Field of Classification Search ..... 36/3 B, 36/3 R, 29, 35 B, 147, 37, 140
See application file for complete search history.

(56) References Cited

U.S. PATENT DOCUMENTS 2,090,881 A * 8/1937 Wilson ..... 36/29
4,223,455 A * 9/1980 Vermeulen ..... 36/29
4,654,982 A * 4/1987 Lee ..... 36/3 R
5,233,767 A * 8/1993 Kramer ..... 36/28
5,477,626 A * 12/1995 Kwon ..... 36/3 B
5,619,809 A * 4/1997 Sessa ..... 36/3 R
5,815,949 A * 10/1998 Sessa ..... 36/3 B
6,076,282 A * 6/2000 Brue' ..... 36/3 B
6,209,226 B1 * 4/2001 Squadroni ..... 36/3 B
6,266,898 B1 * 7/2001 Cheng ..... 36/29
6,282,813 B1 * 9/2001 Squadroni ..... 36/3 B
6,754,982 B2 * 6/2004 Reed et al. ..... 36/30 A
6,922,914 B2 * 8/2005 Pfander ..... 36/28

* cited by examiner

*Primary Examiner*—Jila M Mohandesi
(74) *Attorney, Agent, or Firm*—IPLA P.A.; James E. Bame

(57) ABSTRACT

Disclosed is an air-circulating and shock-absorbing shoe that protects the backbone and knee joints and provides smooth air circulation for pleasant wearing of shoes for a long time. The shoe includes an outsole formed with the firstfirst and secondsecond air chambers, a midsole and an insole formed with multiple air suction holes connected with the firstfirst air chamber, and a check valve formed in the secondsecond air chamber of the outsole. The shoe is formed with multiple concaved holes on the bottoms of the firstfirst and secondsecond air chambers, multiple air cushion projections formed on the bottom of the midsole and inserted into the concaved holes, and shock-absorbing holes formed on the top of the air cushion projections.

12 Claims, 9 Drawing Sheets

AIR-CIRCULATING SHOCK ABSORBING SHOES

CROSS REFERENCE

This application claims foreign priority under Paris Convention and 35 U.S.C. §119 to Korean Patent Application No. 10-2007-0012456, filed Feb. 7, 2007 with the Korean Intellectual Property Office.

BACKGROUND OF THE INVENTION

The present invention relates to a shoe, in more particular, an air-circulating and shock absorbing shoe which can protect backbone and knee joints of the wearer by absorbing shock and enables smooth air circulation inside the shoes, during walking or running, to provide pleasant wearing of the shoes for a long time.

Generally, shoes are worn for walking or running. Shoes are indispensable in our daily life. Their types can be classified by some tens of kinds such as athletic shoes, leather shoes, slippers, basketball shoes, football shoes, golf shoes, combat shoes, mountain climbing shoes, etc.

Recently, functional shoes are being developed for comfortable wearing and helping healthy life.

In addition, the moderners have various problems in their bodies, including obesity, due to excessive nutrient and lack of exercise due to the development of technologies such as transportation means.

Recently, many people enjoy jogging for their health, wearing light footgear and training clothes.

However, conventional shoes need better shock absorbing capability to protect backbone and knee joints from shock in walking and running. Furthermore, conventional shoes give fatigue to feet due to their unsatisfactory structural cushion. Especially in walking or running, the impact of body weight is transferred to the wearer without buffering, giving more fatigue with time.

In addition, because the conventional shoes do not provide air circulation inside, they result in moisturization inside, which promotes propagation of bacteria and fungi producing malodor and foot diseases.

SUMMARY OF THE INVENTION

The object of the present invention is to provide an air-circulating and shock-absorbing shoe that solves the above-mentioned problems of the conventional shoes. The shoes in accordance with the present invention protect backbone and knee joints from impact reducing feet fatigue even under increased physical exercise, and protect feet from various skin diseases and malodor by smooth air ventilation, so that the wearers can wear the shoes more comfortably and pleasantly for a long time.

In order to achieve said objects, the shoes in accordance with the present inventions comprise outsoles formed with first and second air chambers having multiple concave holes, and multiple air cushion projections which are arranged to be inserted in the concave holes on the bottom of the midsoles facing said outsoles and formed with shock-absorbing holes on top of said air cushion projections.

BRIEF DESCRIPTION OF THE DRAWINGS

These and other features, aspects and advantages of the present invention will become better understood with reference to the accompanying drawings, wherein.

DETAILED DESCRIPTION OF THE INVENTION

Figure 1:
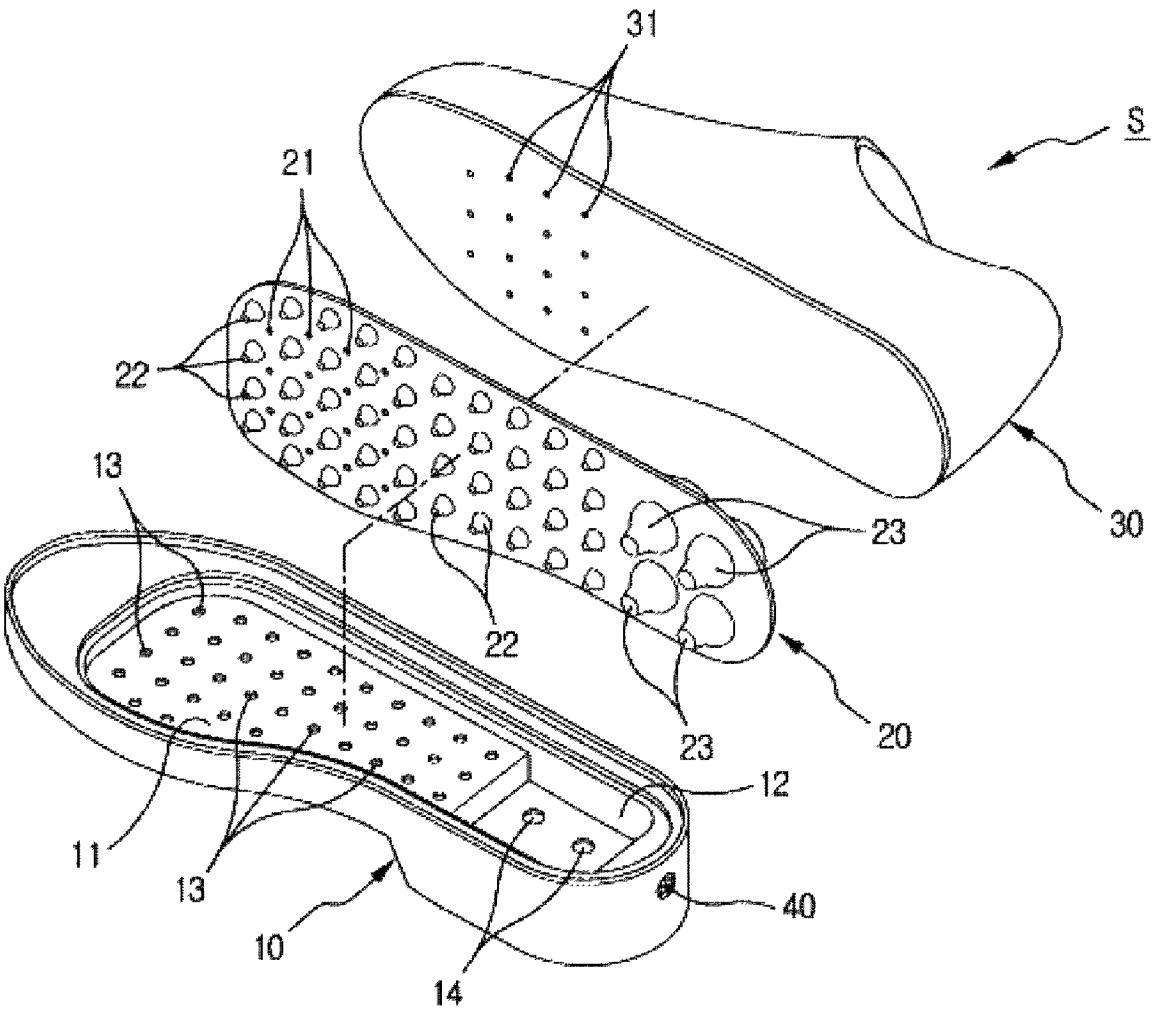
FIG. 1 shows an exploded perspective view of an embodiment of the present invention.
Figure 2:
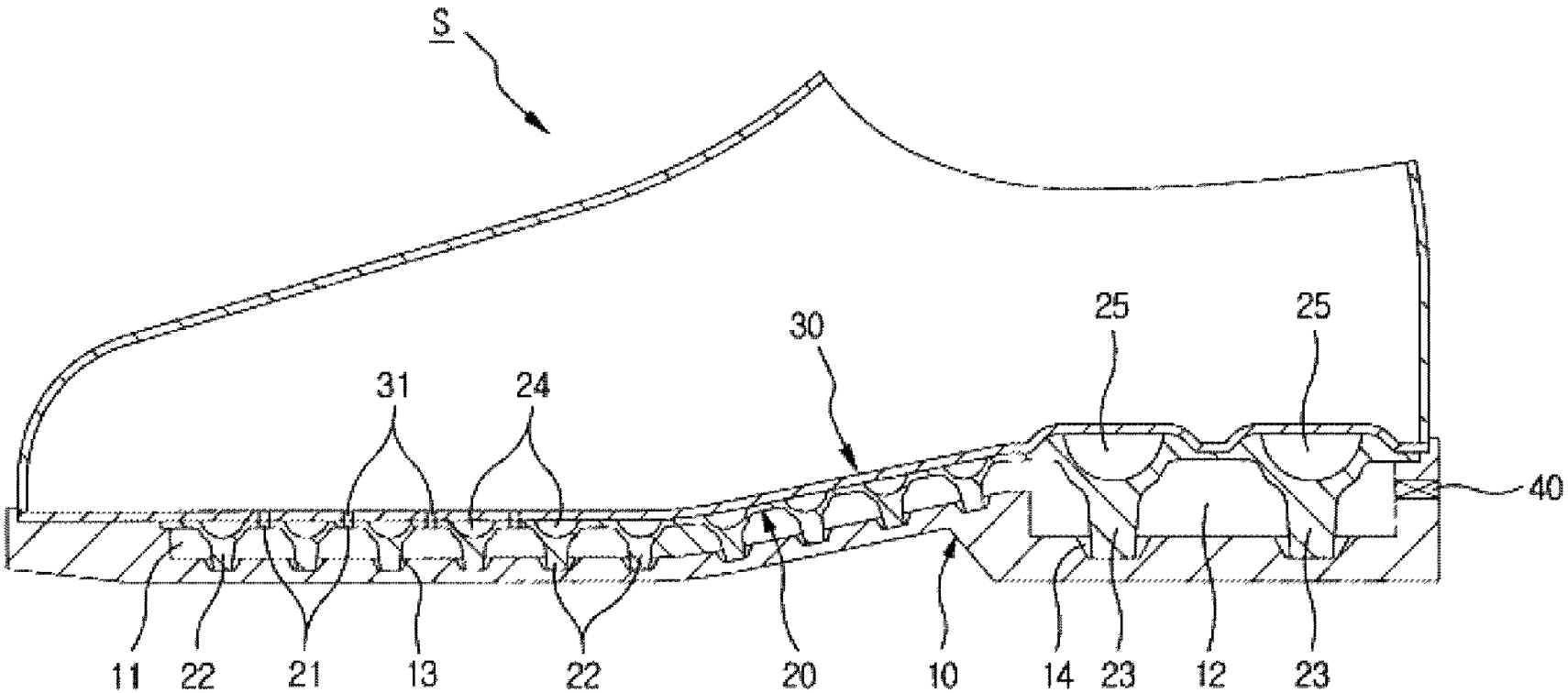
FIG. 2 shows a cross sectional view of an embodiment of the present invention.
Figure 3:
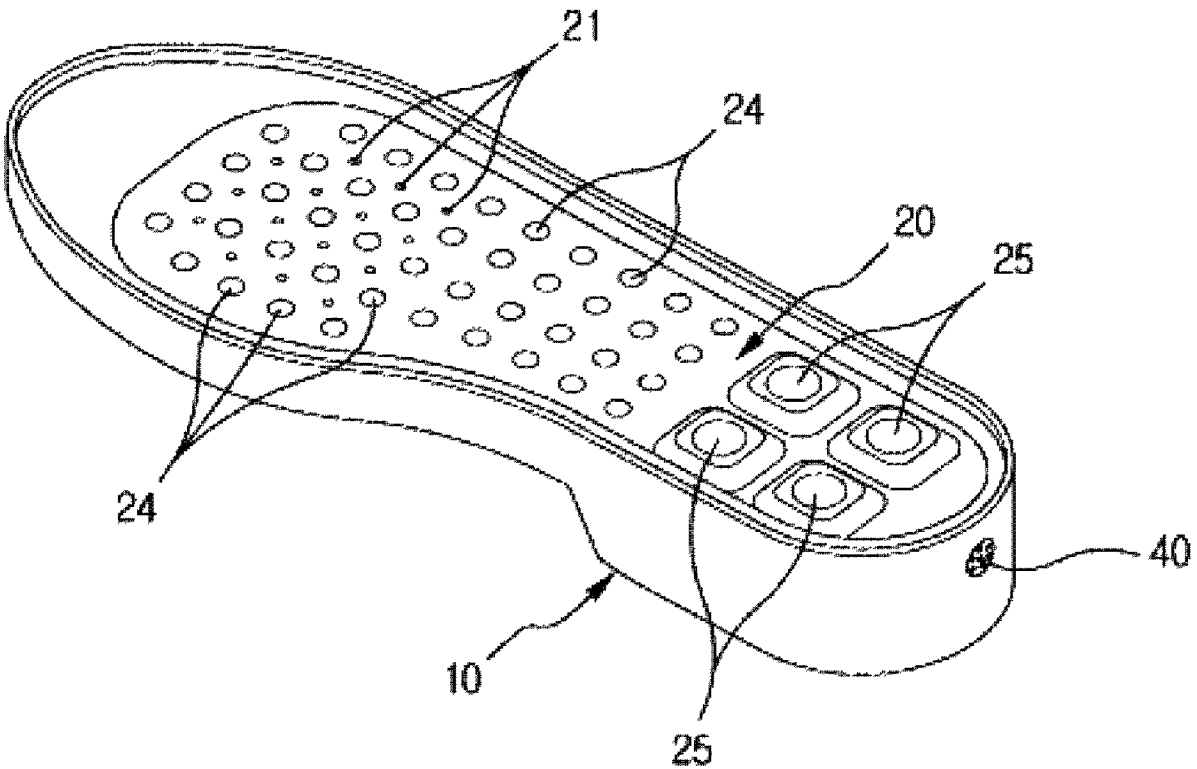
FIG. 3 shows the perspective view of the combination of the outsole and midsole of an embodiment of the present invention.

The functions and their effects of said members set forth and described hereinabove are described herein below;

The air-circulating and shock-absorbing shoe in accordance with the present invention is characterized by, as shown in the FIG. 1 to FIG. 7*b*, an outsole 10 formed with the first air chamber 11 and the second air chamber 12 which are connected together, a midsole 20 and an insole 30 formed with multiple suction holes 21, 31 which are in connection with said first air chamber 11, and the check valve 40 in said second air chamber 12 of the outsole, wherein the bottoms of said first air chamber 11 and second air chamber 12 are formed with multiple concave holes 13, 14 in arrangements, the bottom of said midsole 20 is formed with multiple air cushion projections 22, 23 which are inserted into said concave holes 13, 14, and the top of the air cushion projections 22, 23 are formed with shock absorbing holes 24, 25.

Here, said shoe comprises all the footwear, which has outsole 10, midsole 20, and insole 30, and the shoe may be produced in various sizes according to wearers' age, sex, and foot size.

Said first air chamber 11 is formed on the top front and middle part of the outsole 10 and connected with the second air chamber 12. The first air chamber is inserted with the air cushion projection 22 of the midsole 20.

Said second air chamber 12, which is formed on the rear part of the outsole 10 and connected with the first air chamber 11, contains the air cushion projections 23 of the midsole 20 and formed with a check valve 40 at the rear side to evacuate air to outside.

Said concave hole 13 is formed on the bottom of the first air chamber 11 and inserted with the bottom of the air cushion projections 22.

Said concave hole 14 is formed and arranged on the bottom of said second air chamber 12 and inserted with the bottom part of the air cushion projections 23.

Said air suction holes 21, 31 are formed on the front sides of the midsole 20 and insole 30, connected together with each other, and connected with the first air chamber 11 formed on the outsole 10.

The fresh air comes in through the air suction holes 31 during walking or running.

Said air cushion projections 22, 23 are formed and arranged on the bottom side of the midsole 20, inserted into said concave holes 13, 14, inserted into the first and second air chambers 11, 12, and configured to absorb shock and circulate air during walking. Since said midsole 20 is made with soft material having elasticity, when the front side of foot presses the midsole 20 during walking, said air cushion projection 22 is compressed, as illustrated in the FIG. 5*b*, absorbing the impact. Also when the rear heel side of foot presses the midsole 20, said air cushion projection 23 is compressed, as illustrated in the FIG. 6*b*, absorbing the impact.

Figure 7A:
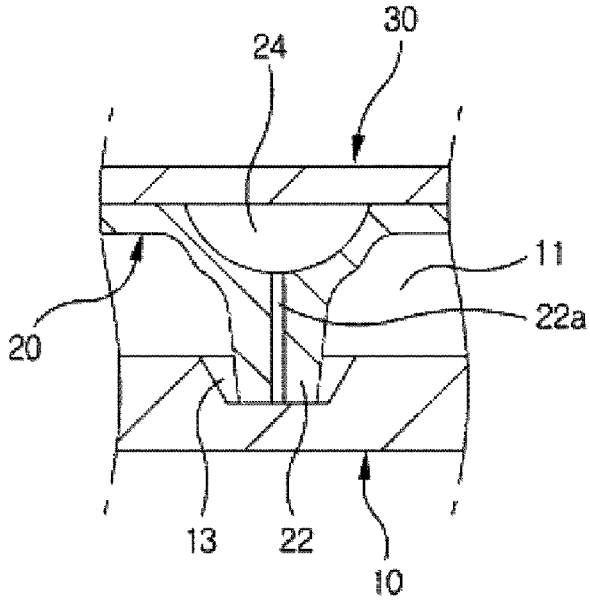
FIGS. 7*a* and 7*b* are cross sectional views of another embodiment of the air cushion projections in accordance with this invention.
Figure 7B:
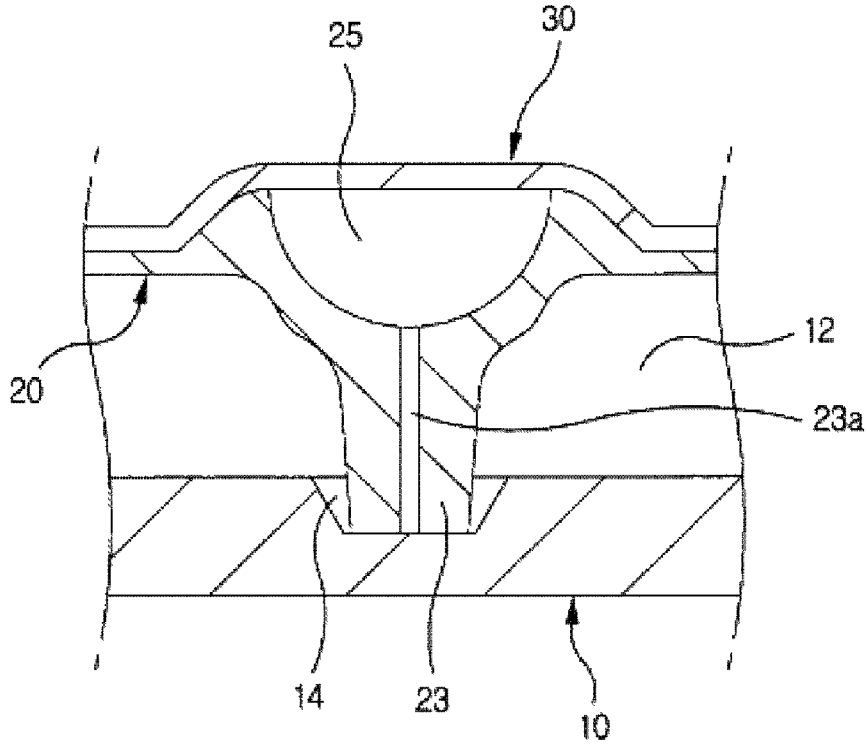

FIGS. 7*a* and 7*b* show another embodiment of the air cushion projections 22, 23 in accordance with the present invention, which is characterized in that the air cushion projections 22, 23 is formed with connecting holes 22*a*, 23*a* inside. The connecting holes 22*a*, 23*a* are configured to circulate air during walking and reduce the weight of midsole.

Said shock absorbing holes 24, 25, which are formed on top of said air cushion projections 22, 23, help said air cushion projections 22, 23 carry out shock-absorbing function by being compressed and expanded as illustrated in the FIGS. 5*a*, 5*b* and FIGS. 6*a*, 6*b*.

In addition, according to an embodiment of the present invention, said insole 30 is characterized by being made with high density compressed pad containing anion emitting powder and herb powder.

Said anion emitting powder comprises elvan, germanium, rigid mica, loess, amphibole, charcoal, nephrite, ceramic, etc. The anions emitted from these materials may coexist with cations, carbon dioxide, oxygen, nitrogen, and moisture in the air, and very active due to their light weight, and their bioenergy helps human health. The anions also sterilize fungi and bacteria, and purify pollutants in the air, providing pleasantness which one feels in forests and near waterfalls and spas, in addition to such effects as purification of blood, activation of body cells, improvement of resistance against bacteria, and smooth harmonization of autonomic nerves.

Said herb powder comprises a mixture of functional herbs including angelica gigas, cnidium officinate makino, mint, workwood, amomi cardamomi fructus, clove, milk vetch, coptidis rhizome, cyperi rhizome, Aucklandia lappa Decne., Teucruim veronicoides, teucerium veronicoides, borneolum, cinnamon, etc., the ingredients of which are absorbed into the foot skin, removing the malodor and protecting foot from athlete's foot and eczema. Therefore, by mixing said herb powders, various effects including malodor removal, sweat absorption, prevention of athlete's foot and propagation of bacteria and fungi, and putrefaction can be acquired.

Said check valve 40 is formed to provide a path between the second air chamber 12 and outside to evacuate air when the second air chamber is compressed and cut-off air flow when the second air chamber 12 is expanded.

The combined functions of the above described members are described herein below.

When not worn, said first and second air chambers 11, 12 of the shoe in accordance with the present invention remain expanded due to the elasticity of said air cushion projections 22, 23.

When walking or running wearing the shoe, said first and second air chambers 11, 12 and said air cushion projections 22, 23 are compressed and expanded in turns providing shock-absorbing and air circulating functions.

Figure 4A:
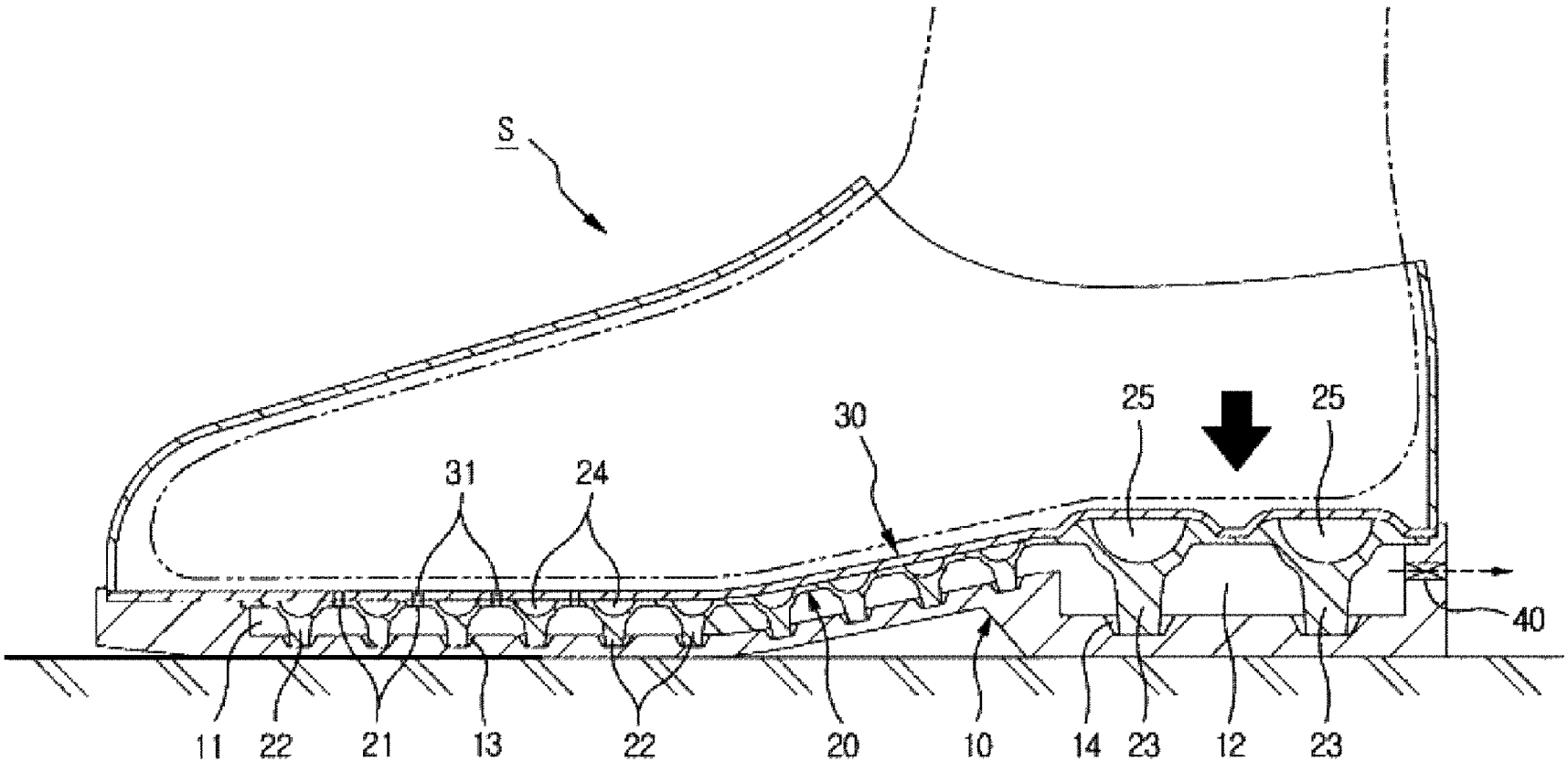
FIGS. 4*a*, 4*b* and 4*c* illustrate the cross sectional views of the working state of an embodiment of the present invention.
Figure 4B:
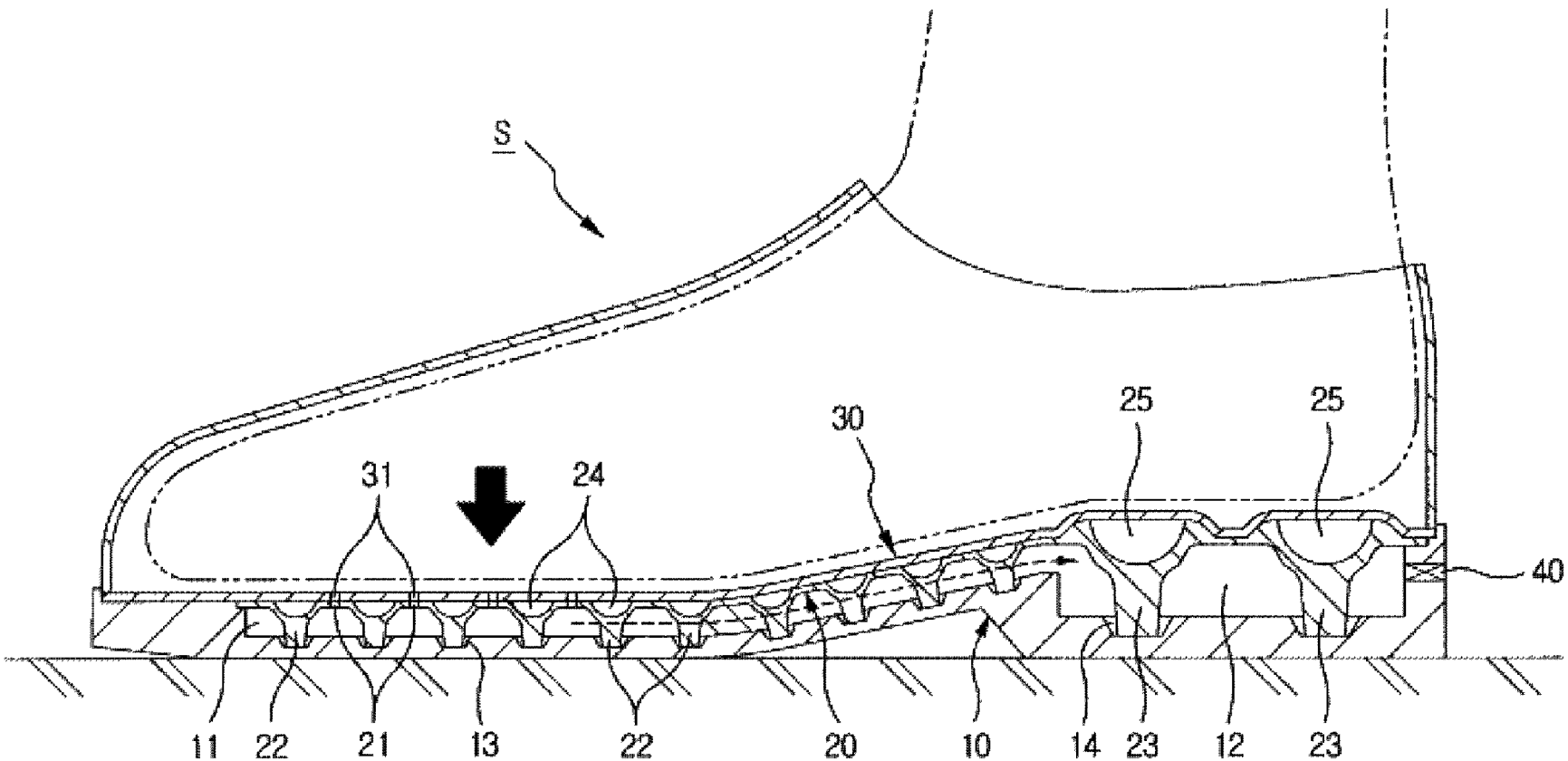
Figure 4C:
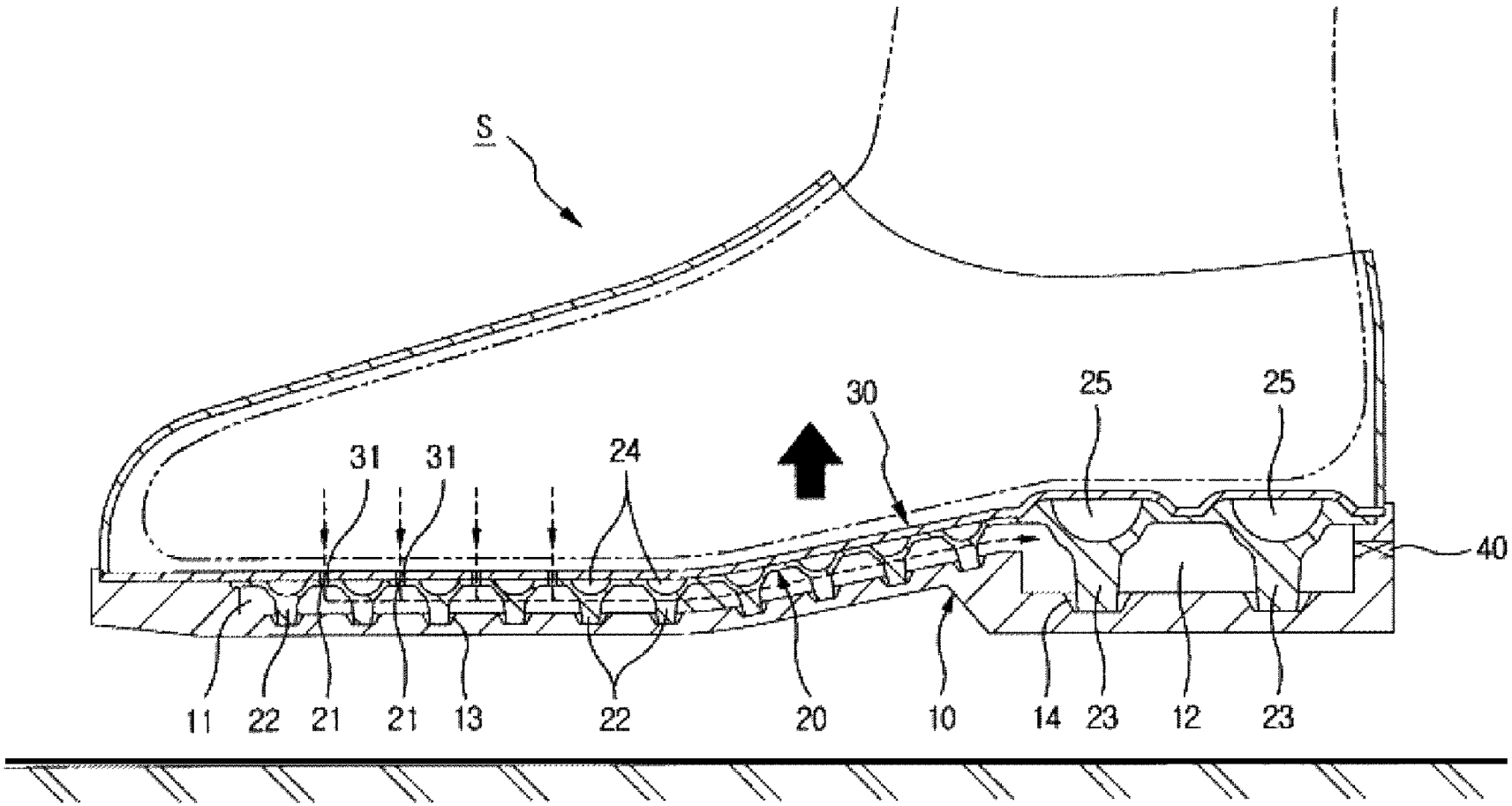
Figure 5A:
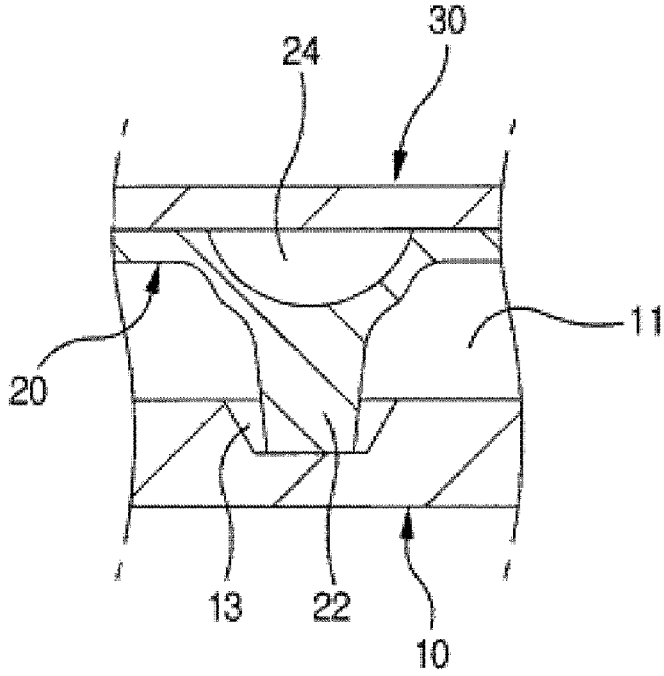
FIGS. 5*a*, 5*b*, 6*a* and 6*b* illustrate the cross sectional views of the shock absorbing function of the air cushion projections in accordance with the present invention.
Figure 5B:
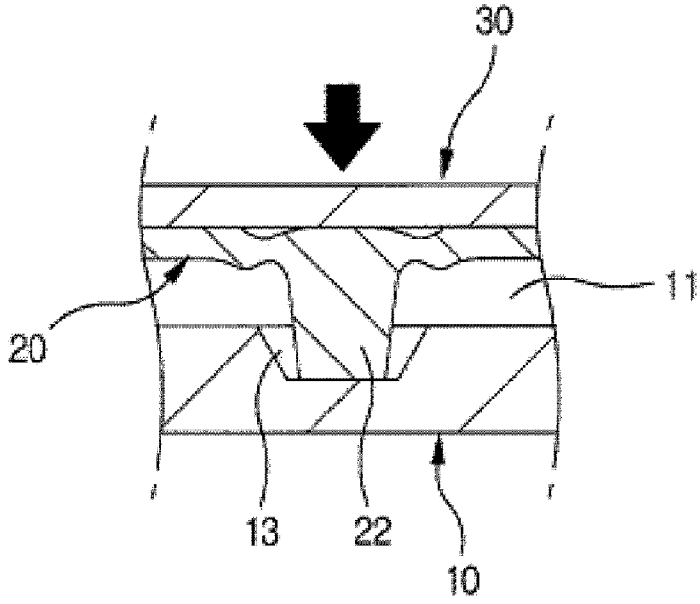
Figure 6A:
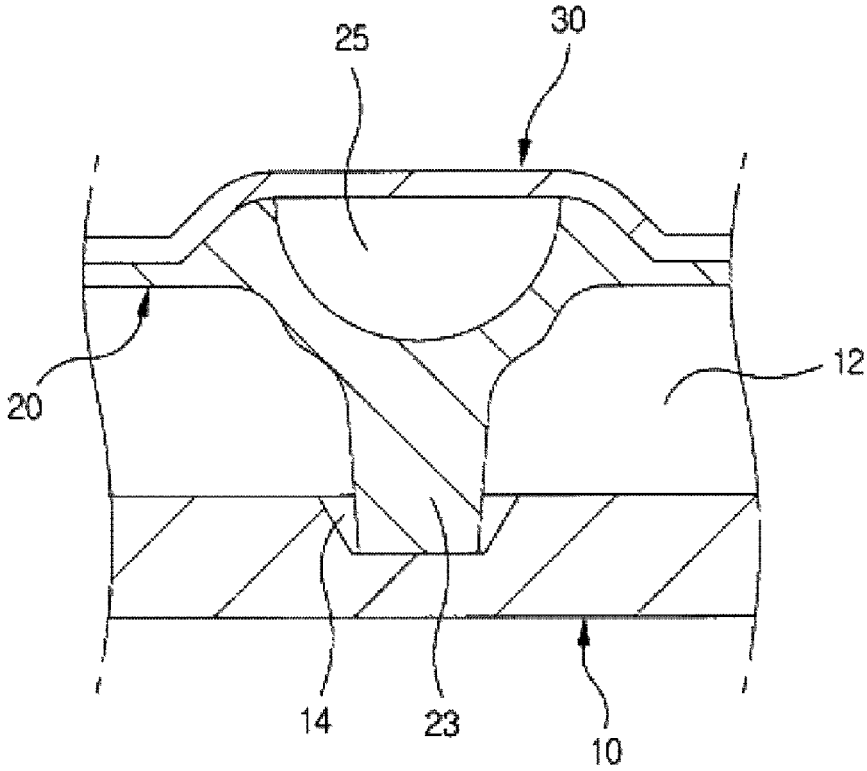
Figure 6B:
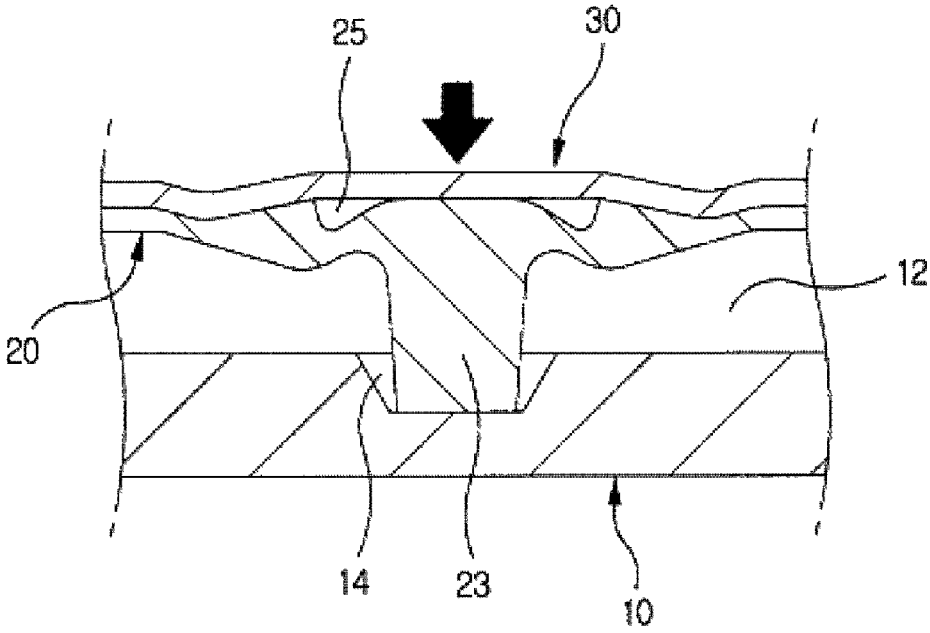

First, as shown in FIG. 4*a*, when the heel side of foot presses the insole 30 and midsole 20 during walking or running, said second air chamber 12 is compressed by the pressure, causing the compression of said air cushion projections 23 of the midsole 20 to absorb the shock, and evacuating the air compressed in said second air chamber 12 out through said check valve 40.

Next, when the toe side of the foot presses the insole 30 and midsole 20, said first air chamber 11 is compressed, making the air cushion projections 22 of the midsole compressed to absorb shock.

When the shoe is lifted up from the ground, said first and second air chambers 11, 12 are expanded by the restoring force of the air cushion projections 22, 23, providing negative pressure in said first and second air chambers 11, 12. Therefore, fresh air is introduced into said first air chamber 11 through said suction holes 21, 31 of the midsole 20, and the air flows into said second air chamber 12. The fresh air circulates in the shoe in this manner.

Therefore, the air-circulating, shock-absorbing shoes in accordance with the present invention have such merits as, due to their shock-absorbing capability, minimizing feet fatigue and protecting backbone and knee joints from impact force during walking or running, helping users to promote their health by increasing the volume of physical exercise, and preventing various geriatric diseases caused by lack of physical exercise.

In addition, the air-circulating and shock-absorbing shoes in accordance with the present invention have such advantages of removing malodor, preventing athlete's foot and providing comfort and pleasantness to wearers for a long time since the fresh air is circulated in the shoes during walking or running.

Furthermore, an embodiment in accordance with the present invention provides insole 30 containing herb powders, and the powders which emit anions, thus preventing propagation of bacteria and malodor, removing athlete's foot, eczema, itches, and inflammations, releasing fatigue of feet by helping blood circulation, and maintaining feet in healthy state by absorbing sweat.

As was set forth hereinabove, the air-circulating and shock-absorbing shoes in accordance with the present invention is a very useful invention that can help promote health by protecting backbone and knee joints from impact, reducing fatigue of feet, and increasing the volume of physical exercise during walking or running, and with the circulation of fresh air, and removing malodor and prevent foot diseases, so that users can wear the shoes for a long time more pleasantly.

While the invention has been shown and described with reference to different embodiments thereof, it will be appreciated by those skills in the art that variations in form, detail, compositions, and operation may be made without departing from the spirit and scope of the invention as defined by the accompanying claims.

What is claimed is:

1. An air-circulating and shock-absorbing shoe comprising:

an outsole comprising first and second air chambers which are connected together;

midsole and insole comprising multiple number of air suction holes which are connected with said first air chamber; and a check valve formed in said second air chamber of said outsole, wherein the bottom sides of said first and second air chambers are formed with multiple concave holes, wherein the bottom of said midsole is formed with multiple air cushion projections so arranged to be fit with said concave holes, and wherein top of said air cushion projections are formed with shock-absorbing holes.

2. The shoe of claim 1, wherein said air cushion projections comprise air circulation holes inside, wherein each of said air circulation holes connects said shock absorbing hole and the concave hole.

3. The shoe of claim 1, wherein said insole comprises a high density compressed pad, and wherein the high density compressed pad comprises powders which emit anions.

4. The shoe of claim 3, wherein Said anion emitting powder comprises elvan, germanium, rigid mica, loess, amphibole, charcoal, nephrite, and ceramic.

5. The shoe of claim 1, wherein said insole comprises a high density compressed pad, and wherein the high density compressed pad comprises herb powders.

6. The shoe of claim 5, Said herb powder comprises a mixture of functional herbs, and wherein the functional herbs comprise angelica gigas, cnidium officinate makino, mint, workwood, amomi cardamomi fructus, clove, milk vetch, coptidis rhizome, cyperi rhizome, Aucklandia lappa Decne., Teucruim veronicoides, teucerium veronicoides, borneolum, and cinnamon.

7. The shoe of claim 1, wherein said air suction holes are formed on the front sides of the midsole and insole.

8. The shoe of claim 7, wherein said suction holes formed on the midsole are connected with said suction holes formed on the insole.

9. The shoe of claim 7, wherein said air suction holes are configured to suck in fresh air through the air suction holes during walking or running.

10. The shoe of claim 1, wherein said check valve is configured to provide a path between said second air chamber and outside to evacuate air when said second air chamber is compressed and to cut-off air flow when the second air chamber is expanded.

11. The shoe of claim 1, wherein when the shoe is not worn said first and second air chambers remain expanded due to the elasticity of said air cushion projections.

12. The shoe of claim 11, wherein when walking or running with the shoe worn said first and second air chambers and said air cushion projections are compressed and expanded in turns providing shock-absorbing and air circulating functions.

* * * * *